US007458240B1

(12) United States Patent
Miao

(10) Patent No.: US 7,458,240 B1
(45) Date of Patent: Dec. 2, 2008

(54) COMBINATION PADLOCK WITH A NAME CARD

(75) Inventor: Tony Miao, Taipei Hsien (TW)

(73) Assignee: Jin Tay Industries Co., Ltd., Taishan Hsiang, Taipei Hsien (TW)

( * ) Notice: Subject to any disclaimer, the term of this patent is extended or adjusted under 35 U.S.C. 154(b) by 0 days.

(21) Appl. No.: 11/878,413

(22) Filed: Jul. 24, 2007

(51) Int. Cl.
*E05B 37/06* (2006.01)

(52) U.S. Cl. ..... 70/21; 70/25; 70/51; 70/54; 70/284; 70/460; 40/330

(58) Field of Classification Search ..... 70/21, 70/25–30, 38 A, 284, 285, 51, 52, 54–56, 70/460; 40/330
See application file for complete search history.

(56) References Cited

U.S. PATENT DOCUMENTS

| | | | | | |
|---|---|---|---|---|---|
| 462,667 | A * | 11/1891 | Goldbeck | 40/6 |
| 1,841,266 | A * | 1/1932 | Jones | 40/634 |
| 3,589,155 | A * | 6/1971 | Kamp | 70/459 |
| 3,863,468 | A * | 2/1975 | Bach | 70/50 |
| 3,908,418 | A * | 9/1975 | Stoffel | 70/456 R |
| 3,971,458 | A * | 7/1976 | Koenig | 190/120 |
| 4,271,352 | A * | 6/1981 | Thomas | 235/375 |
| 4,349,975 | A * | 9/1982 | Chubb | 40/330 |
| 4,408,406 | A * | 10/1983 | Barton | 40/660 |
| 5,143,466 | A * | 9/1992 | Moncrieff Baldwin et al. | 402/79 |
| 5,180,192 | A * | 1/1993 | Herbert | 283/101 |
| 5,181,927 | A * | 1/1993 | Song | 362/116 |
| 5,400,625 | A * | 3/1995 | Embry | 70/38 A |
| 6,408,660 | B1 * | 6/2002 | Lai | 70/30 |
| 6,615,626 | B2 * | 9/2003 | Yu et al. | 70/301 |
| 6,860,126 | B2 * | 3/2005 | Ling | 70/30 |
| 7,121,123 | B2 * | 10/2006 | Yu | 70/21 |
| 7,225,648 | B2 * | 6/2007 | Lai et al. | 70/21 |
| 7,269,985 | B2 * | 9/2007 | Lai et al. | 70/446 |
| 7,325,425 | B1 * | 2/2008 | Miller | 70/52 |
| 2004/0226324 | A1 * | 11/2004 | Loughlin et al. | 70/25 |
| 2005/0044901 | A1 * | 3/2005 | Yu | 70/25 |
| 2005/0262902 | A1 * | 12/2005 | Ling et al. | 70/21 |
| 2006/0027000 | A1 * | 2/2006 | Yu | 70/21 |
| 2006/0037368 | A1 * | 2/2006 | Yu | 70/52 |
| 2006/0107708 | A1 * | 5/2006 | Yu | 70/21 |
| 2006/0107710 | A1 * | 5/2006 | Yu | 70/25 |
| 2006/0150690 | A1 * | 7/2006 | Lai et al. | 70/21 |
| 2006/0266084 | A1 * | 11/2006 | Kuo et al. | 70/21 |
| 2007/0262594 | A1 * | 11/2007 | Hudson et al. | 292/328 |

* cited by examiner

*Primary Examiner*—Suzanne D Barrett
(74) *Attorney, Agent, or Firm*—Muncy, Geissler, Olds, & Lowe PLLC

(57) ABSTRACT

A combination padlock with a name card has a housing, a card clamp, multiple dial cores, a shackle, a locking shaft and a key core. The housing has a card surface. The card clamp is mounted detachably on the card surface and holds a name card to indicate who owns the padlock. The dial cores are mounted in the housing, have a combination and provide a combination locking capability. The shackle is U-shaped and has a mounting end and a locking end. The mounting end is mounted through the dial cores. The locking end detaches from the housing. The locking shaft is mounted in the housing and selectively meshes the shackle with the dial cores. The key core is mounted in the housing, locks and releases the shackle by a key and allows a person to unlock the padlock when the combination is forgotten.

5 Claims, 9 Drawing Sheets

COMBINATION PADLOCK WITH A NAME CARD

BACKGROUND OF THE INVENTION

1. Field of the Invention

The present invention relates to a padlock, and more particularly to a combination padlock that includes a name card to indicate who owns the padlock.

2. Description of the Prior Arts

A conventional padlock is often used to lock a door, a box or the like that a person doesn't want other people to open. However, a corresponding key is required to open the padlock. Keeping the key is not always convenient.

A conventional combination padlock comprises a dial core with numbers and is unlocked by rotating the dial core to a particular sequence of numbers. The combination padlock is unlocked without a key, but a particular sequence of numbers is always used. The particular sequence of numbers is called "the combination" of the lock, and the combination must be remembered all the time. If the combination is forgotten, the padlock cannot be unlocked. This is particularly inconvenient for people who don't remember numbers well.

In some situations like luggage checks at airports, luggage should be locked and have a nametag. The nametag detaching from the luggage might cause the luggage to be transferred to an improper destination or to be lost.

To overcome the shortcomings, the present invention provides a combination padlock with a name card to mitigate or obviate the aforementioned problems.

SUMMARY OF THE INVENTION

The primary objective of the present invention is to provide a combination padlock that includes a name card and can be unlocked either by a key or a combination.

A combination padlock with a name card in accordance with the present invention has a housing, a card clamp, multiple dial cores, a shackle, a locking shaft and a key core. The housing has a card surface. The card clamp is mounted detachably on the card surface and holds a name card to indicate who owns the padlock and has a top and a locking hole defined in the top. The dial cores are mounted in the housing, have a combination and provide a combination locking capability. The shackle is U-shaped and has a mounting end mounted slidably and rotatable in the housing and being selectively latched, and a locking end corresponding to and selectively aligning with the locking hole of the card clamp, being selectively mounted through the locking hole of the card clamp. The mounting end is mounted through the dial cores. The locking end detaches from the housing. The locking shaft is mounted in the housing and selectively meshes the shackle with the dial cores. The key core is mounted in the housing, locks and releases the shackle by a key and allows a person to unlock the padlock when the combination is forgotten.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
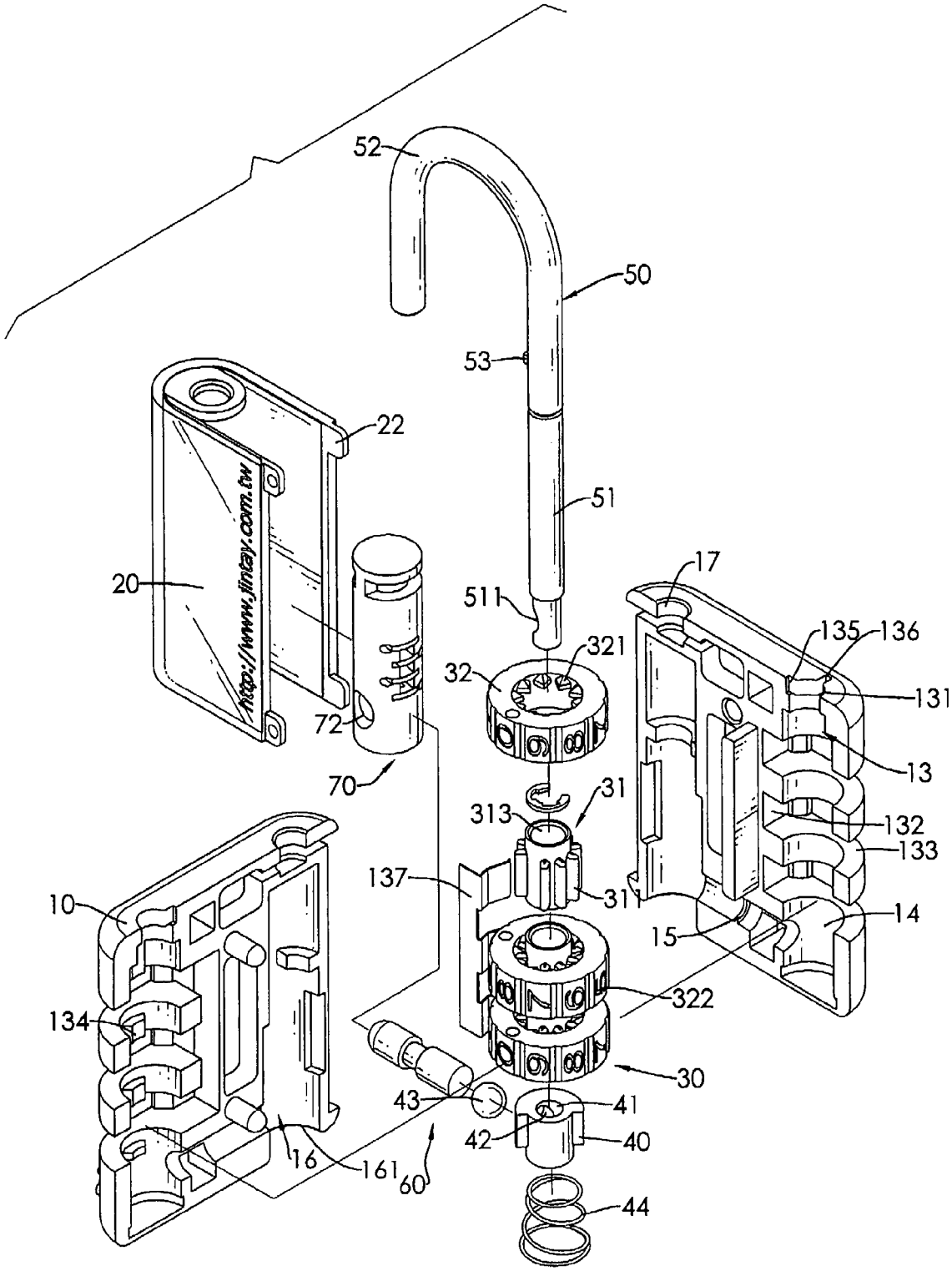
FIG. 1 is an exploded perspective view of a combination padlock with a name card in accordance with the present invention.
Figure 2:
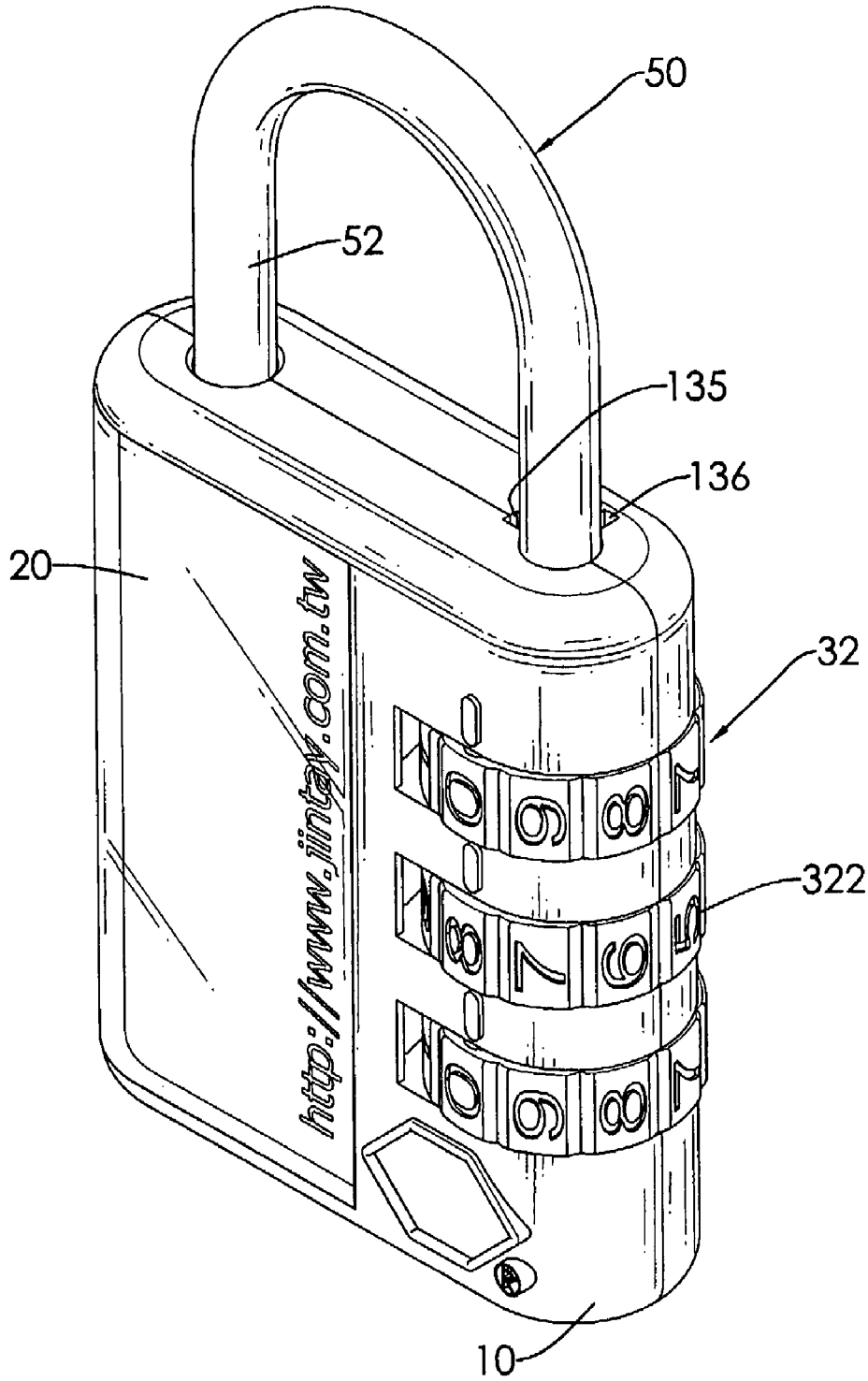
FIG. 2 is a perspective view of the combination padlock in FIG. 1.
Figure 3:
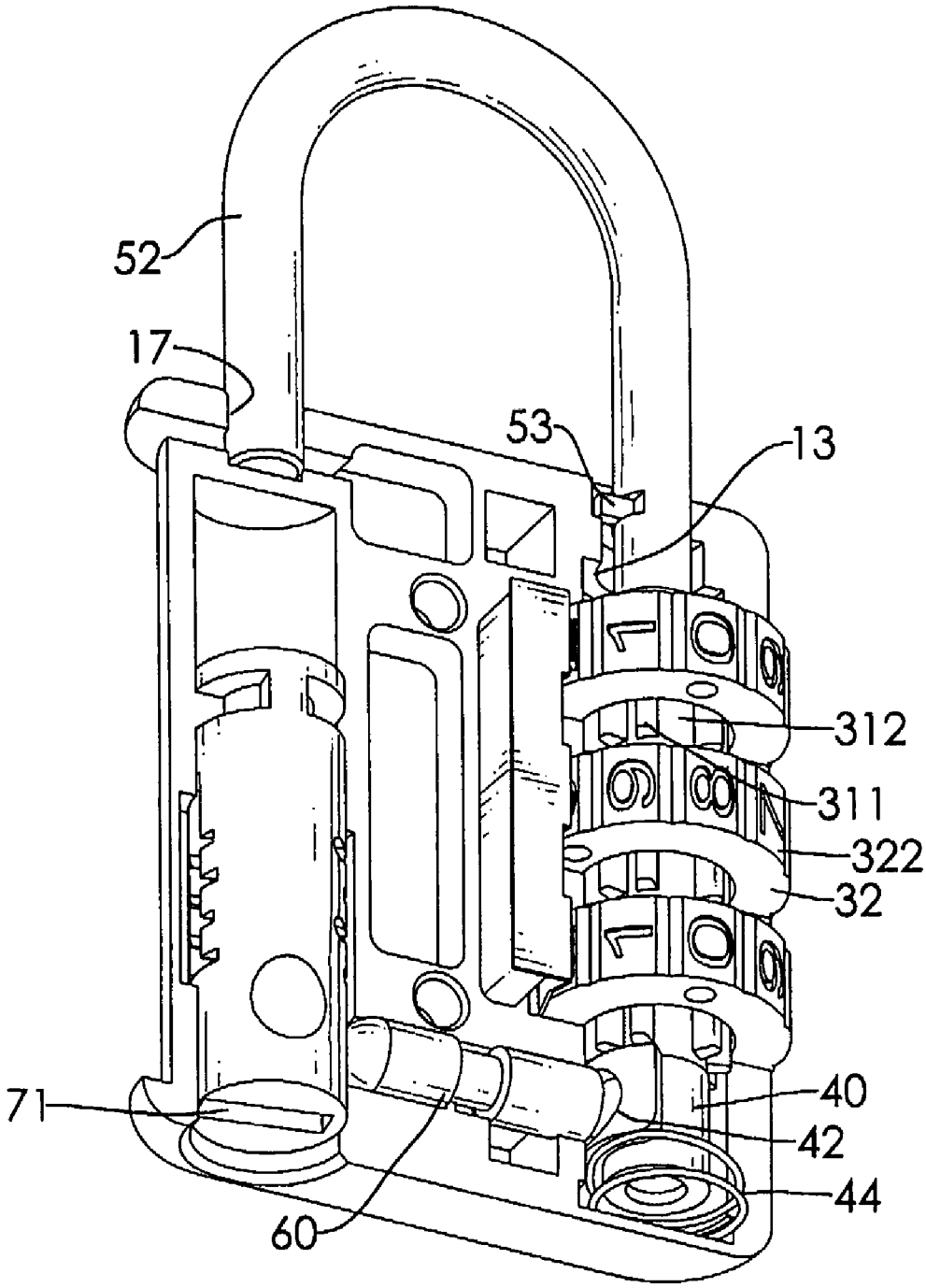
FIG. 3 is a perspective view of the combination padlock in FIG. 1 with half of the housing removed.

With reference to FIGS. 1 to 3, a combination padlock with a name card in accordance with the present invention comprises a housing (10), a card clamp (20), multiple dial cores (30), a locking limit (40), a shackle (50), a locking shaft (60) and a key core (70).

Figure 4:
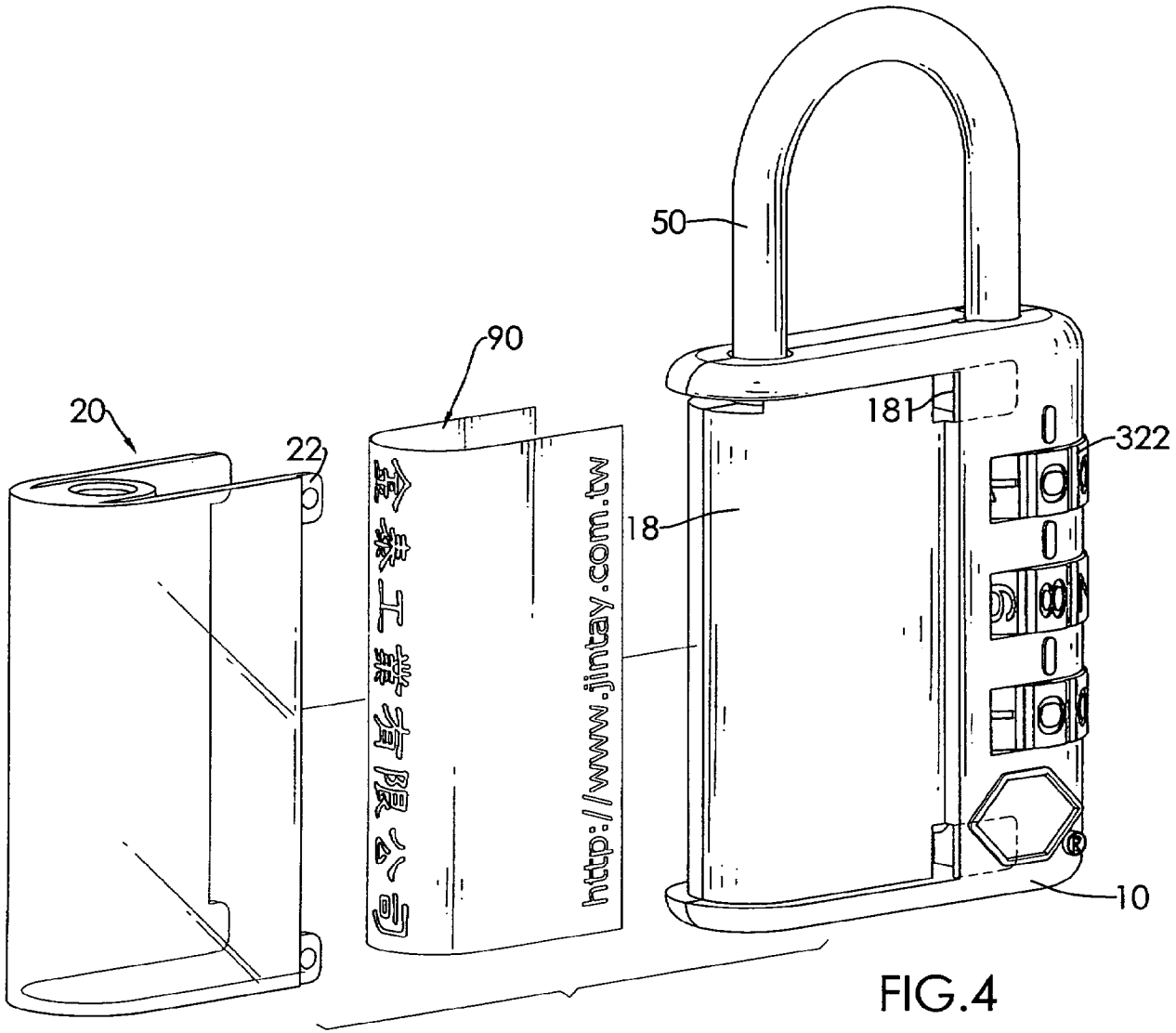
FIG. 4 is an operational exploded perspective view of the combination padlock in FIG. 1 with a name card being mounted on the padlock.

With further reference to FIG. 4, the housing (10) comprises two housing halves and has an outside surface, a top, a bottom, a proximal side, a distal side, a dial core cavity (13), a cavity extension (14), a locking shaft cavity (15), a key core cavity (16), a locking recess (17) and a card surface (18).

The dial core cavity (13) is formed longitudinally in the proximal side of the housing (10) through the top, has an inner surface, an opening (131), multiple annular recesses (132), multiple windows (133), multiple protrusions (134), a slot (135) and may have a positioning slot (136).

The opening (131) is formed in the top of the housing (10) and communicates with the dial core cavity (13).

The annular recesses (132) are larger than the dial core cavity (13) and are formed coaxially in the dial core cavity (13).

The windows (133) are formed in the proximal side of the housing (10), communicate with the dial core cavity (13) and correspond respectively to the annular recesses (132).

The protrusions (134) are formed on and protrude in from the inner surface of the dial core cavity (13) adjacent respectively to the annular recesses (13) and are arranged in a row.

The slot (135) is formed longitudinally in the opening (131) and has a bottom.

The positioning slot (136) is formed longitudinally in the opening (131) and is deeper than the slot (135).

The cavity extension (14) is formed in the housing (10) coaxially with the dial core cavity (13), communicates with the dial core cavity (13) and has a bottom.

The locking shaft cavity (15) is straight, is formed in the housing (10) and has two ends. One end of the locking shaft cavity (15) communicates with the cavity extension (14).

The key core cavity (16) is formed in the bottom of the housing (10) on the distal side, communicates with the other end of the locking shaft cavity (15) and has an opening (161).

The opening (161) of the key core cavity (16) is formed in the bottom of the housing (10) coaxially with the key core cavity (16) and communicates with the key core cavity (16).

The locking recess (17) is formed in the top of the housing (10) on the distal side.

The card surface (18) is formed in the housing (10) on the distal side, holds a name card (90), may be recessed from the outside surface of the housing (10), has a mounting surface and may have multiple connecting slots (181). The connecting slots (181) are formed in the mounting surface of the card surface (18).

The card clamp (20) is transparent, corresponds to and is mounted on the mounting surface of the card surface (18) to hold a name card (90) on the card surface (18) and has a top and a locking hole and may have multiple tabs (22). The locking hole is defined in the top of the card clamp (20) and selectively corresponds to the locking recess (17) of the housing (10) when the card clamp (20) is mounted on the mounting surface of the card surface (18) (with reference to FIGS. 7 and 8). The tabs (22) correspond respectively to and are detachably mounted in the connecting slots (181) to hold the card clamp (20) in place and allow the card clamp (20) to be removed so the name card (90) can be changed or replaced.

The dial cores (30) are coaxially mounted rotatably in the dial core cavity (13), are arranged in a row and provide a locking capability for the combination padlock, and each dial core (30) has a shaft (31) and a dial ring (32).

Figure 5:
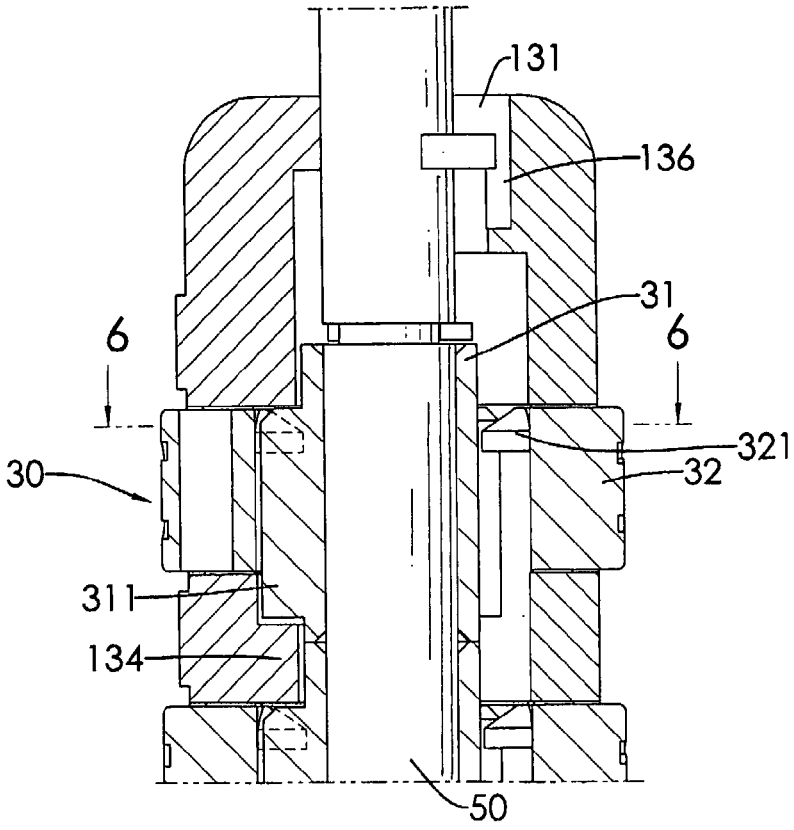
FIG. 5 is an enlarged side view in partial section of the combination padlock along line 5-5 in FIG. 9.
Figure 6:
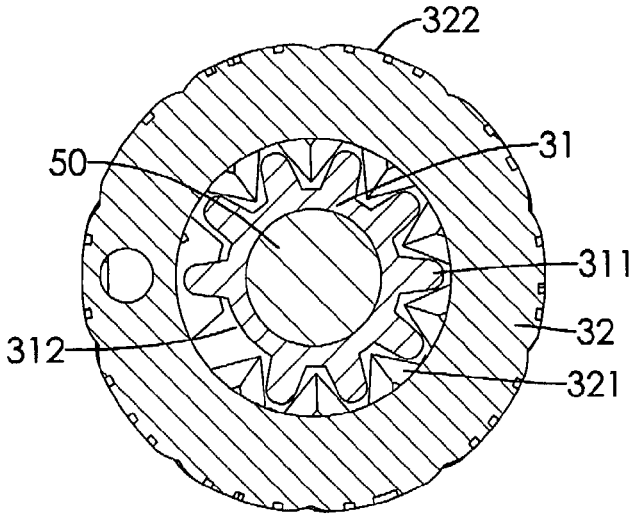
FIG. 6 is a top view in partial section of the combination padlock along line 6-6 in FIG. 5.

With further reference to FIGS. 5 and 6, the shaft (31) is tubular, is mounted coaxially, slidably and rotatably in the dial core cavity (13), abuts adjacent shafts (31) and has an outside surface, multiple ribs (311), a gap (312) and a through hole (313).

The ribs (311) are formed longitudinally on the outside surface of the shaft (31) around the shaft (31), protrude radially from the outside surface of the shaft (31) and are between adjacent protrusions (134). One of the ribs (311) protrudes into the two corresponding protrusions (134) to keep the shaft (31) from moving longitudinally when the dial core (30) is locked. Each rib (311) has an outer end. The outer end points to the opening (131).

The gap (312) is formed on the outside surface of the shaft (31) by removing one of the ribs (311) and is bigger than the corresponding protrusions (134) to allow the shaft (31) to move upwards and downwards when the gap (312) corresponds to the protrusion (134) by rotating the shaft (31). The gaps (312) of all the shafts (31) align with the protrusions (134) when the dial cores (30) are unlocked.

The through hole (313) is formed coaxially through the shaft (31).

The dial rings (32) are mounted rotatably respectively in the annular recesses (132) and are mounted coaxially, slidably and rotatably around the shaft (31), and each dial ring (32) has a ring hole, an outer surface, an inner surface, multiple teeth (321) and multiple numbers (322).

The outer surface of the dial ring (32) is exposed partially in the corresponding window (133), which allows the dial ring (32) to be rotated.

The teeth (321) are formed on and protrude in from the inner surface of the dial ring (32), are flush with the shaft (31) and engage the outer ends of the ribs (311) to connect the dial ring (32) to the shaft (31).

The numbers (322) are formed sequentially around the outer surface of the dial ring (32) and the numbers (322) of the dial rings (32) corresponding to a combination to unlock the combination padlock are exposed respectively in the windows (133) when the gaps (312) of all the shafts (31) align with the protrusions (134). Each number (322) composing the combination can be changed by rotating the number (322) only when the shafts (30) move downwards to release the outer ends of the ribs (311) from engaging with the teeth (321).

The locking limit (40) is mounted coaxially, slidably and rotatably in the cavity extension (14), abuts the nearest shaft (31) of the dial cores (30), is able to enter the ring hole of the dial ring (32) when moving upwards and has a bottom, an outer surface, a rod hole (41), an annular hole (42), a retaining ball (43) and a spring (44).

The outer surface is annular and corresponds and is adjacent to the locking shaft cavity (15).

The rod hole (41) is formed coaxially through the locking limit (40) and aligns with the through holes (313) in the shafts (31).

The annular hole (42) is formed in the outside surface of the locking limit (40) and communicates with the rod hole (41).

The retaining ball (43) is mounted movably in the annular hole (42) and is able to partially enter the rod hole (41) and the locking shaft cavity (15).

The spring (44) is mounted between the bottom of the cavity extension (14) and the bottom of the locking limit (40) to keep the locking limit (40) from dropping.

The shackle (50) is U-shaped, is mounted in the dial core cavity (13) and the cavity extension (14) and has a mounting end (51), a locking end (52) and a positioning protrusion (53).

The mounting end (51) is mounted slidably and rotatably through the through holes (313) in the shafts (31), is mounted in the rod hole (41) of the locking limit (40) and has a recess (511). The recess (511) is bowl-like and corresponding to the retaining ball (43).

The locking end (52) corresponds to and selectively aligns with the locking recess (17) and the locking hole of the card clamp (20) (with reference to FIGS. 7 and 8), is mounted slidably and detachably in the locking recess (17) and is extending through and positioned securely in the locking recess (17) and the locking hole of the card clamp (20) when the combination padlock is locked, thereby effectively lock securely the card clamp (20) on the housing (10).

The positioning protrusion (53) is formed on and protrudes from the shackle (50), corresponds to the slot (135) and the positioning slot (136), is positioned in the slot (135) when the combination padlock is locked, reaches the bottom of the slot (135) to prevent the shackle (50) from extending into the housing (10) too deeply.

The locking shaft (60) is mounted slidably in the locking shaft cavity (15) and has a pressing end (61) and a leading end (62).

Figure 7:
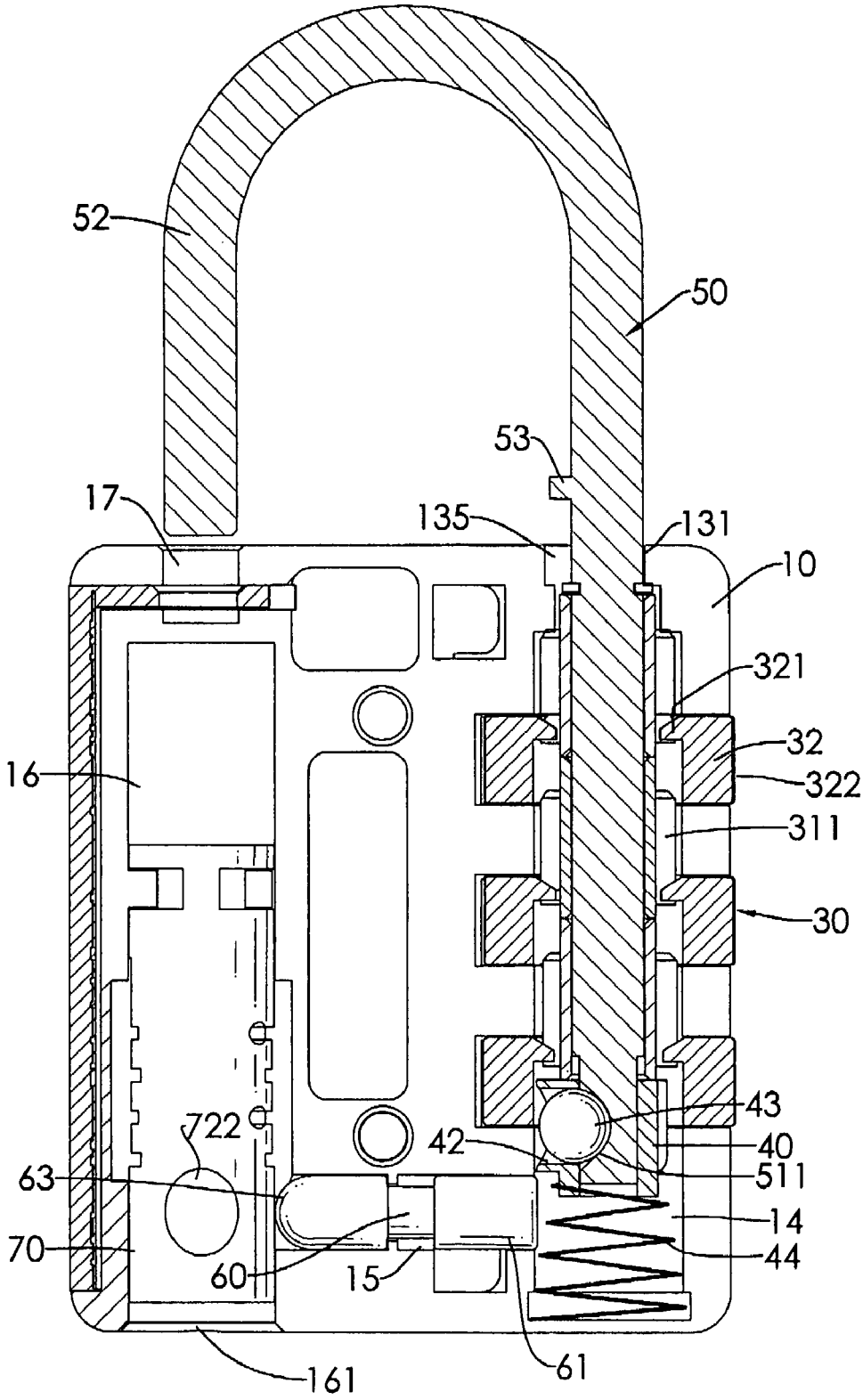
FIG. 7 is an operational front view in partial section of the combination padlock in FIG. 1 with the dial cores being unlocked.

With further reference to FIG. 7, the pressing end (61) corresponds to the retaining ball (43), may be flat and selectively presses the retaining ball (43) into the recess (511) in the shackle (50) to lock the shackle (50), the shafts (31) and the locking limit (40) together.

Figure 8:
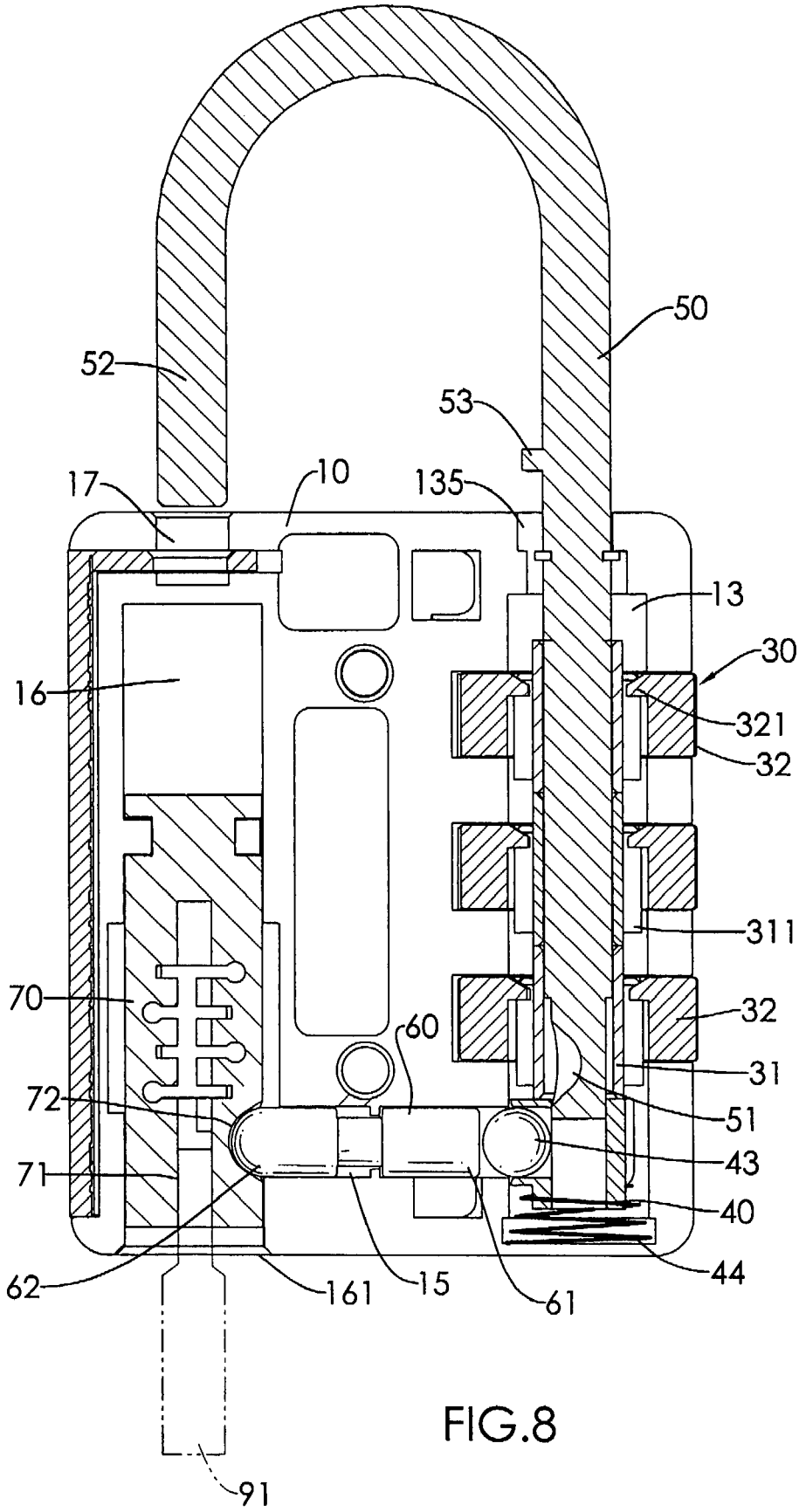
FIG. 8 is an operational front view in partial section of the combination padlock in FIG. 1 with an appropriate key unlocking the key core.

With further reference to FIG. 8, the leading end (62) may be round, faces the key core cavity (16) and is able to move partially into the key core cavity (16) to release the retaining ball (43).

The key core (70) is able to be unlocked and rotated by an appropriate key (91), is mounted securely in the key core cavity (16) and has an outside surface, a keyhole (71) and a recess (72).

The outside surface of the key core (70) presses the locking shaft (60) to keep the retaining ball (43) in the recess (511) of the shackle (50) when the key core (70) is locked to make the combination padlock only be unlocked by dialing the correct combination to unlock the dial cores (30).

The keyhole (71) communicates with the opening (161) and allows the user to insert the appropriate key (91) to rotate the key core (70).

The recess (72) is formed on the outside surface of the key core (70), corresponds to the leading end (62) of the locking shaft (60) and faces the leading end (62) when the key core (70) is unlocked. The recess (72) allows the locking shaft (60) to move in and release the shackle (50) from the shafts (30) and the locking limit (40) and allows the combination padlock to be unlocked by pulling out the shackle (50) when the correct combination is lost.

Figure 9:
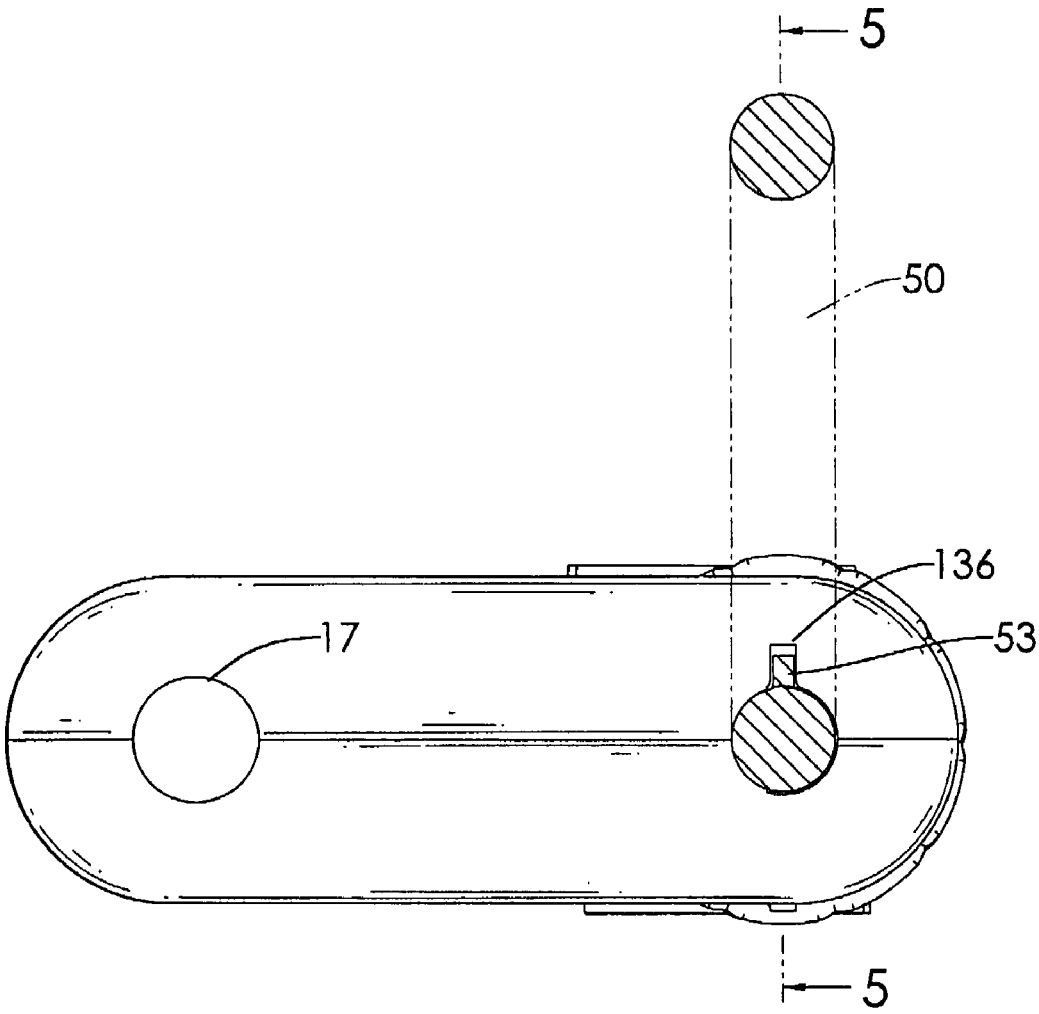
FIG. 9 is an operational top view of the combination padlock in FIG. 1 with the shackle being rotated to press the positioning protrusion into the positioning slot.
Figure 10:
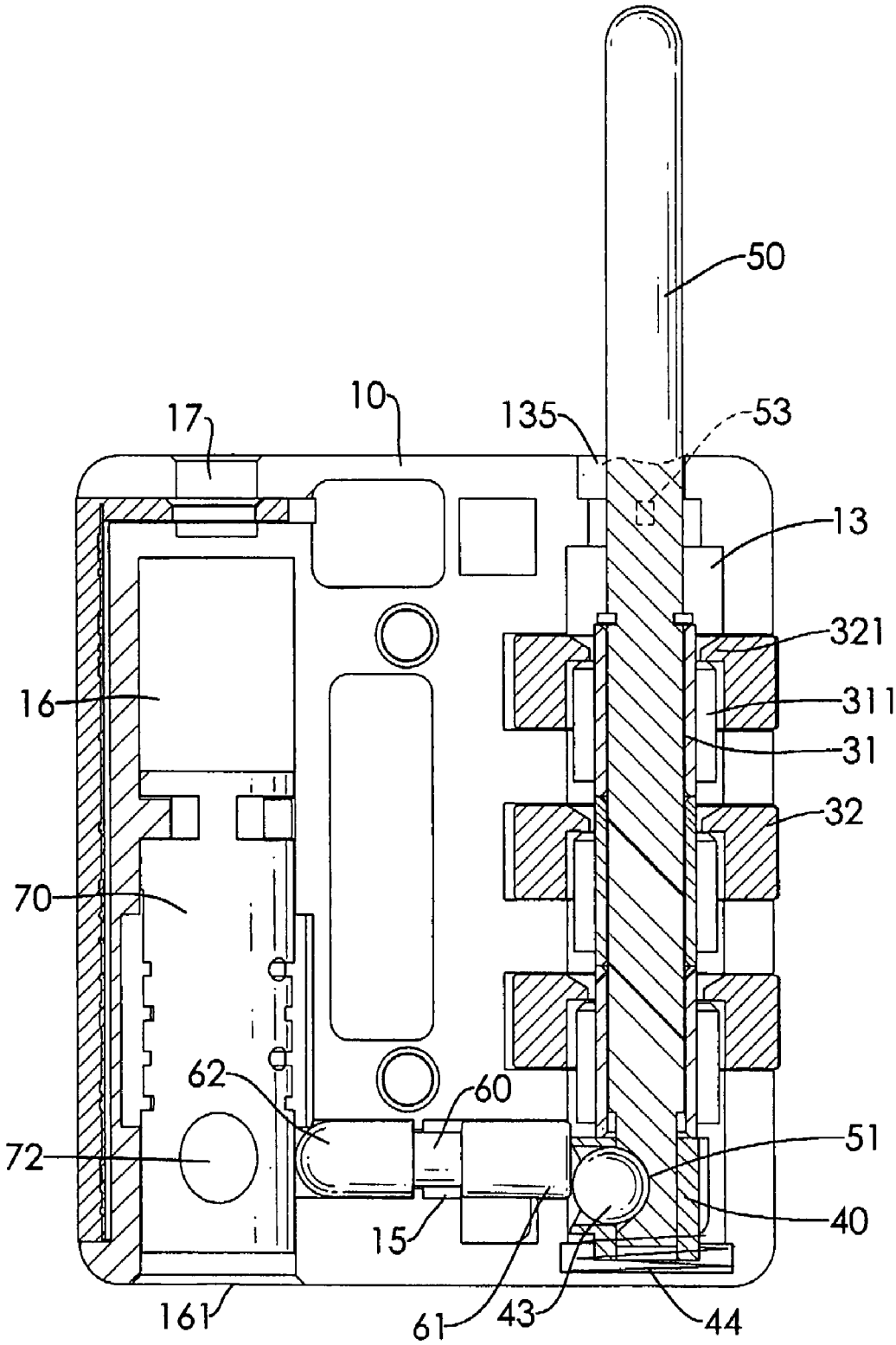
FIG. 10 is an operational front view in partial section of the combination padlock in FIG. 1 with the shackle and the shafts of the dial cores being pressed downwards to change the combination.

With further reference to FIGS. 9 and 10, the combination can be changed by rotating and pressing the shackle (50) downwards to make the protrusion (53) enter the positioning slot (136) against the spring (43) and detaching the shafts (31) from the dial ring (32) when the dial cores (30) are unlocked.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A combination padlock comprising a housing comprising two housing halves and having
- an outside surface;
- a top;
- a bottom;
- a proximal side;
- a distal side;
- a locking recess being formed in the top of the housing on the distal side; and
- a card surface being formed in the housing on the distal side and having a mounting surface; and a card clamp being transparent, corresponding to and being mounted on the mounting surface of the card surface and having
- a top; and
- a locking hole being defined in the top of the card clamp and selectively corresponding to the locking recess of the housing when the card clamp is mounted on the mounting surface of the card surface; and a U-shaped shackle having
- a mounting end being mounted slidably and rotatably in the housing and being selectively latched;
- a locking end corresponding to and selectively aligning with the locking recess and the locking hole of the card clamp, being selectively mounted through the locking recess and the locking hole of the card clamp.

2. The combination padlock as claimed in claim 1, wherein the card surface of the housing is recessed from the surface of the housing and has multiple connecting slots formed in the mounting surface of the card surface; and the card clamp has multiple tabs corresponding to and detachably mounted in the connecting slots.

3. The combination padlock as claimed in claim 2, wherein the housing further has
- a dial core cavity being formed longitudinally in the proximal side of the housing through the top and having
  - an inner surface;
  - an opening being formed in the top of the housing and communicating with the dial core cavity;
  - multiple annular recesses being larger than the dial core cavity and being formed coaxially in the dial core cavity;
  - multiple windows being formed in the proximal side of the housing, being adjacent to the proximal side, communicating with the dial core cavity and corresponding respectively to the annular recesses;
  - multiple protrusions being formed on and protruding in from the inner surface of the dial core cavity adjacent respectively to the annular recesses and being arranged in a row; and
  - a slot being formed longitudinally in the opening and having a bottom;
- a cavity extension being formed in the housing coaxially with the dial core cavity, communicating with the dial core cavity and having a bottom;
- a locking shaft cavity being straight, being formed in the housing and having two ends, one end of the locking shaft cavity communicating with the cavity extension; and
- a key core cavity being formed in the bottom of the housing on the distal side, communicating with the other end of the locking shaft cavity and having an opening being formed in the bottom of the housing coaxially with the key core cavity and communicating with the key core cavity;

multiple dial cores are coaxially mounted rotatably in the dial core cavity and are arranged in a row, and each dial core has
- a shaft being tubular, being mounted coaxially, slidably and rotatably in the dial core cavity, abutting adjacent shafts and having
  - an outside surface;
  - multiple ribs being formed longitudinally on the outside surface of the shaft around the shaft, protruding radially from the outside surface of the shaft and being between adjacent protrusions, each rib having an outer end pointing to the opening of the dial lock cavity;
  - a gap being formed on the outside surface of the shaft by removing one of the ribs and being bigger than corresponding protrusions; and
  - a through hole being formed coaxially through the shaft; and
- a dial ring being mounted rotatably in a corresponding annular recess, being mounted coaxially, slidably and rotatably around the shaft and having
  - a ring hole;
  - an outer surface being exposed in a corresponding window;
  - an inner surface;
  - multiple teeth being formed on and protruding in from the inner surface of the dial ring, being flush with the shaft and engaging the outer end of the ribs; and
  - multiple numbers being formed sequentially around the outer surface of the dial ring;

a locking limit is mounted coaxially, slidably and rotatably in the cavity extension, abuts a nearest shaft of the dial cores, selectively enters the ring hole of a corresponding dial ring and has
- a bottom;
- an outer surface being annular, corresponding and being adjacent to the locking shaft cavity;
- a rod hole being formed coaxially through the locking limit and aligning with the through holes in the shafts;
- an annular hole formed in the outside surface of the locking limit and communicating with the rod hole;

a retaining ball being mounted movably in the annular hole and selectively partially entering the rod hole and the locking shaft cavity; and a spring mounted between the bottom of the cavity extension and the bottom of the locking limit;

a locking shaft is mounted slidably in the locking shaft cavity and has a pressing end corresponding to the retaining ball and selectively pressing the retaining ball; and a leading end facing the key core cavity and selectively moving partially into the key core cavity; and a key core is selectively unlocked and rotated, is mounted securely in the key core cavity and has an outside surface selectively pressing the locking shaft;

a keyhole communicating with the opening in the key core cavity; and a recess being formed on the outside surface of the key core, corresponding to the leading end of the locking shaft and selectively facing to the leading end; and wherein the U-shaped shackle is mounted in the dial core cavity and the cavity extension and the mounting rod end is mounted slidably and rotatably through the through holes in the shafts, being mounted in the rod hole of the locking limit and having a recess being bowl-like and corresponding to the retaining ball;

the locking end corresponding to and selectively aligning with the locking recess, being mounted slidably and detachably in the locking recess; and the U-shaped shackle further has a positioning protrusion being formed on and protruding from the shackle and corresponding to the slot.

4. The combination padlock as claimed in claim 3, wherein the dial core cavity further has a positioning slot formed longitudinally in the opening and being deeper than the slot in the housing; and the positioning protrusion on the shackle corresponds to the positioning slot.

5. The combination padlock as claimed in claim 4, wherein the pressing end of the locking shaft is flat; and the leading end of the locking shaft is round.

* * * * *